US011268764B2

(12) United States Patent
Maggioli

(10) Patent No.: US 11,268,764 B2
(45) Date of Patent: Mar. 8, 2022

(54) DEVICE FOR MOUNTING AND/OR DISMANTLING STAVES IN A SHAFT FURNACE

(71) Applicant: PAUL WURTH S.A., Luxembourg (LU)

(72) Inventor: Nicolas Maggioli, Thionville (FR)

(73) Assignee: PAUL WURTH S.A., Luxembourg (LU)

( * ) Notice: Subject to any disclaimer, the term of this patent is extended or adjusted under 35 U.S.C. 154(b) by 2 days.

(21) Appl. No.: 16/618,626

(22) PCT Filed: May 28, 2018

(86) PCT No.: PCT/EP2018/063925
§ 371 (c)(1),
(2) Date: Dec. 2, 2019

(87) PCT Pub. No.: WO2019/001870
PCT Pub. Date: Jan. 3, 2019

(65) Prior Publication Data

US 2020/0182546 A1 Jun. 11, 2020

(30) Foreign Application Priority Data

Jun. 28, 2017 (LU) ..... 100 328

(51) Int. Cl.
*F27D 1/16* (2006.01)

(52) U.S. Cl.
CPC ..... *F27D 1/1621* (2013.01); *F27D 1/1694* (2013.01); *F27D 2201/00* (2013.01)

(58) Field of Classification Search
CPC .. F27D 1/1621; F27D 1/1694; F27D 2201/00; F27D 1/16
See application file for complete search history.

(56) References Cited

U.S. PATENT DOCUMENTS 2,812,863 A * 11/1957 Ralston ..... F27D 1/1621 212/71
3,058,543 A * 10/1962 Prosser ..... C21C 5/441 182/128

(Continued)

FOREIGN PATENT DOCUMENTS

JP S6036790 A 2/1985
JP H08157919 A 6/1996

(Continued)

OTHER PUBLICATIONS

International Search Report dated Jul. 18, 2018 re: Application No. PCT/EP2018/063925, pp. 1-3, citing: JP H08 157919 A, U.S. Pat. No. 4,036,483 A and JP 2003 049209 A.

(Continued)

*Primary Examiner* — Scott R Kastler
(74) *Attorney, Agent, or Firm* — Cantor Colburn LLP

(57) ABSTRACT

A device for mounting and/or dismantling staves on/from an inner wall of a shaft furnace, the device including a circular monorail for supporting at least one stave positioning hoist, where the monorail is divided into at least four separate arc portions, where each arc portion is connected to a neighboring arc portion by means of a rotatable connection, the arc portions are moveable between an unfolded position, in which the arc portions form a circular monorail, and a folded position, in which the overall size of the monorail is, in one direction, reduced.

18 Claims, 5 Drawing Sheets

(56) References Cited

U.S. PATENT DOCUMENTS

| | | | | |
|---|---|---|---|---|
| 4,036,483 | A | 7/1977 | Bohmer et al. | |
| 5,533,592 | A * | 7/1996 | Lamoureux | E04G 3/24 182/128 |
| 2020/0182546 | A1 * | 6/2020 | Maggioli | F27B 1/24 |

FOREIGN PATENT DOCUMENTS

| | | | |
|---|---|---|---|
| JP | 2003049209 | A | 2/2003 |
| SU | 1196378 | A1 | 12/1985 |

OTHER PUBLICATIONS

Written Opinion dated Jul. 18, 2018 re: Application No. PCT/EP2018/063925, pp. 1-6, citing: JP H08 157919 A, U.S. Pat. No. 4,036,483 A and JP 2003 049209 A.

* cited by examiner

DEVICE FOR MOUNTING AND/OR DISMANTLING STAVES IN A SHAFT FURNACE

TECHNICAL FIELD

The present disclosure relates to the field of maintenance of a stave lining in a shaft furnace. The present disclosure particularly relates to a device for mounting and/or dismantling staves on/from an inner wall of a shaft furnace.

BACKGROUND

In furnaces, particularly shaft furnaces, the interior of the shell is lined with a heat-refractive material in order to isolate the exterior from the interior of the furnace. The heat-refractive material is commonly composed of a plurality of staves, generally made from copper or steel. The staves comprise a network of cooling pipes connected to a cooling system. A cooling fluid, generally water, flows through the cooling pipes in order to further reduce the temperature of the staves. The staves, once installed, constitute a lining comprising a plurality of rows and columns covering the interior of the shaft furnace.

Due to harsh conditions within the furnace, the staves may become damaged and thus require maintenance. Maintenance of the staves generally consists of replacing damaged staves with new ones. The maintenance operation may require tools and/or persons to enter the shaft furnace. Accordingly, in order to carry out such maintenance work, the temperature inside the furnace must be significantly reduced and normal operation of the furnace must be interrupted. As a shaft furnace is generally operated continuously, such maintenance operations necessarily have a direct impact on the furnace performance. Hence, it is a great concern in furnace developments to minimize the duration of the maintenance operations.

Traditional relining operations require the furnace operation to be stopped so as to sufficiently reduce the temperature inside the furnace to allow a person to directly operate therein.

In some furnaces, and in particular in bell-less top furnaces, an opening may be arranged in the top of the furnace for chute maintenance operations. Such an opening may be placed next to the chute or a material inlet. The maintenance opening is sufficiently large to allow a chute to be passed therethrough and its primary use is for repairing the chute.

Solutions for replacing staves forming the lining of a shaft furnace may take advantage of the existing chute maintenance opening. One example is disclosed in JP 19830114390, wherein the furnace is stopped and the charge inside the furnace is lowered to its lowest level. Then, a plurality of hoists and pulleys are installed in the upper part of the furnace through existing holes. The chute maintenance opening is large enough to allow a stave to be passed therethrough. Accordingly, staves are introduced into the furnace through the chute maintenance opening. Then, each stave is lowered down the furnace using a combination of cables on hoist/pulley systems. The stave is then grabbed from the outside of the furnace by a person using a pole, the pole being fed through a hole in the furnace wall. Persons are working from the sides of the furnace and are not required to enter into the furnace.

The latter system requires cables going through different openings of the furnace in order to hold each stave. Each cable is manipulated independently with its respective hoist and pulley. It requires complex preparation and creating several additional openings in the furnace wall. Due to the space required to manipulate a stave, only a limited number of staves can be replaced at the same time. Deployment of the tools for manipulating each stave is neither cost nor time effective. This constraint has a direct impact on the duration of the maintenance operation.

In another solution disclosed in document SU 1196378 A, a circular monorail supported on four posts is mounted inside the shaft furnace. The circular monorail carries a hoist on trolleys. The hoist comprises an arm extendable in a radial direction toward the furnace wall. A stave is lifted by a cable hanging from the hoist and can be transported up and down the furnace. By travelling on the monorail, the hoist can quickly position the stave anywhere along the circumference of the furnace.

The main drawback of this solution is the complexity of the installation. The furnace needs to be fully emptied during maintenance. Moreover, after the operation, a full restart of the furnace further increases delays before the furnace is back to its fully functional stage. In addition, the monorail and its supporting posts have to be mounted inside the shaft furnace and the posts are resting on the bottom surface of the inside of the furnace which is a complex installation.

Other solutions known in the prior art are disclosed in documents JP H08 157919 A; U.S. Pat. No. 4,036,483 A; and JP 2003 049209 A.

BRIEF SUMMARY

It is therefore desirable to provide an improvement to the solution used to replace staves in a shaft furnace. More particularly, the present disclosure provides an improved solution for a system to carry staves during a relining or maintenance operation of a shaft furnace.

The disclosure overcomes the above discussed deficiencies and disadvantages by providing a device for mounting and/or dismantling staves on/from an inner wall of a shaft furnace, the device comprising a circular monorail for supporting at least one stave positioning hoist. According to the disclosure, the monorail is divided into at least four separate arc portions, wherein each arc portion is connected to a neighboring one by means of a rotatable connection. The arc portions are moveable between an unfolded position, in which the arc portions form a circular monorail, and a folded position, in which the overall size of the monorail is, in one direction, reduced.

The skilled person will understand that there may be several positions in which the arc portions are folded. In the context of the present disclosure, the folded position is preferably a completely folded position, wherein the size of the monorail is, in one direction, reduced to its minimum.

An important advantage of the disclosure is that the device for mounting and/or dismantling staves has a monorail which is collapsible into a folded position, wherein the cross-section of the monorail changes from circular to elongate and thin. The thinner configuration of the monorail allows the latter to be inserted into the furnace through a small opening. In particular, the folded monorail may be inserted into the furnace through an existing maintenance opening, such as for example a chute maintenance opening, as generally provided in a bell-less top shaft furnace. According to the disclosure, installation of the monorail does not require specific openings or significant modifications of a shaft furnace. It results in a significant gain in preparation time impacting positively on the furnace downtime.

Preferably, the monorail comprises four arc portions of the same length. The rotatable connections are preferably essentially equidistantly placed along the circumference of the monorail and arranged on two perpendicular axes of symmetry. It reduces the positioning constraints and/or makes manipulation of the monorail easier.

Preferably, in the folded position, two opposite rotatable connections are arranged in proximity to one another, while the other two opposite rotatable connections are arranged far apart from one another. The positions of the rotatable connections ensure that, in the folded position, the size of the monorail is, in one direction, reduced to its minimum. Most preferably, the two opposite connections that are arranged in proximity to one another, are substantially in contact with one another. Hence, when folded, the width of the monorail is significantly reduced in comparison with the diameter of the unfolded monorail. It is then possible to introduce the monorail through narrow passages inside the furnace.

The rotatable connections have their respective rotation axes parallel to each other. This provides for simpler operations when folding and/or unfolding the monorail.

Advantageously, the rotatable connections are formed by a pin construction. Such pin construction may for example comprise a pin interlocking two concentric shaft cylinders from two neighboring arc portions of the monorail. The pin construction being a basic mechanical arrangement, maintenance of the device is simple and does not require complex tools.

In preferred embodiments, the arc portions form a continuous circular monorail when the device is in its unfolded position. Such a continuous circular monorail means that the monorail provides a continuous track for a compatible stave positioning hoist along all of the circumference of the monorail. For example, the monorail may be provided with a stave positioning hoist comprising drive means. A stave held by such a stave positioning hoist traveling on the monorail may be brought to any radial position inside the furnace, thus providing maximum flexibility during maintenance operations.

According to an embodiment, two opposite rotatable connections are laterally arranged on the monorail so as to face the center of the circle formed by the unfolded monorail, while the other two opposite rotatable connections are laterally arranged on the monorail facing away from the center of the circle formed by the unfolded monorail. In these particular arrangements, the rotatable connections are not in line with the arc portions of the monorail. In the unfolded position, the rotatable connections are not hindering a continuous and smooth transition from one arc portion to another. Indeed, the laterally arranged rotatable connections allow for the monorail to be conveniently continuous with no additional parts between the arc portions, allowing a stave positioning hoist to travel from one arc portion to another.

Advantageously, the monorail is configured to support a plurality of stave positioning hoists. Indeed, more than one stave positioning hoist can be attached to the monorail, each hoist being configured to transport one stave. Hence, the monorail may support several staves that may be moved around the monorail into a desired radial position inside the furnace. The relining operation is thus speeded up in comparison with devices configured to hold only one stave at a time. Additionally, by carrying a number of staves, the monorail may be more balanced as the weight of one stave may be used as counterbalance to the weight of another stave.

The arc portions may have a radial cross-section in the form of a double T. Such a cross-section is advantageous in providing the necessary support to carry the stave positioning hoist.

The monorail may further comprise a locking system configured to maintain the device in its unfolded position in such a way that the arc portions form the circular monorail. The stability of the monorail during the stave maintenance operation is important to the functionality of the monorail. The circular position should remain stable for the duration of a maintenance operation. The locking system may be any suitable locking system, automatic or manual. Preferably, the locking system is reversible in order to allow for the monorail to be folded before extraction from the furnace.

Preferably, the locking system comprises at least one abutment between two neighboring arc portions so as to limit the opening of the monorail to its circular position.

The monorail is introduced into the furnace in its folded position. Once inside the furnace, the monorail is then unfolded to form a circular monorail. Advantageously, at least one rotatable connection comprises an actuating means arranged between neighboring arc portions, the actuating means being configured to move one arc portion relative to its neighboring arc portion. Preferably, the actuating means comprises an actuator, such as a hydraulic, pneumatic or electric actuator to fold and unfold the monorail. Although actuating means may also be provided at further rotatable connections, this is not considered necessary. Indeed, due to the fact that the arc portions are connected to one another, the relative movement between two neighboring arc portions entrains the remaining arc portions. A hydraulic actuator may be preferred as there are already hydraulic pressure suppliers around the top of the shaft furnace.

Alternatively, it should be noted that the device may be brought into its unfolded position by using cables attached to the arc portions, the cables preferably extending out of the furnace. By pulling on two cables attached to two neighboring arc portions, the arc portions may be moved so as to open the folded monorail and bring it into its unfolded position to form a circular monorail.

The monorail is preferably mounted inside the shaft furnace by suspension means, the suspension means preferably comprising at least three suspension cables for suspending the monorail within the shaft furnace. Advantageously, the suspension means maintains the monorail at a predetermined position inside the furnace with the monorail being arranged in an essentially horizontal plane. Advantageously, at least four suspension cables may be used, with at least one suspension cable connected to each of the arc portions. It should be noted that the suspension cables may also be used as cables for folding or unfolding the monorail as described above.

Due to the suspension means, the device may be attached exclusively at the top of the furnace. It is thus possible to keep a minimum of hot material in the bottom of the furnace during a stave relining operation. A full stoppage of the shaft furnace is not required for carrying out maintenance operations using the device according to the present disclosure.

The device may further comprise a plurality of hooks or eyebolts on the arc portions in order to connect the monorail to the suspension cables. Hooks and eyebolts are a common solution used for hanging heavy objects. These embodiments are advantageous as the device may be easily separated from the suspension cables for storage.

Advantageously, the suspension cables are fed through existing openings in the furnace and connected to a secure fixing point arranged outside of the furnace. The fixing point may e.g. be arranged on the furnace itself or on a surrounding structure. The use of existing openings, such as for example probe inlets, does not require the need to provide any additional openings that would need closing after the maintenance operation. The connection of the suspension cables to a secure fixing point outside of the furnace allows for easy access to adjust the position of the monorail within the furnace.

The device preferably further comprises a plurality of abutment members to prevent lateral movement of the unfolded monorail within the furnace. The monorail is thus maintained in a fixed position relative to the furnace. It is advantageous as during maintenance, precise actions are performed such as grabbing or positioning the staves. It is important that the device holding the staves in the furnace is firmly fixed without balancing movements. The abutment members may be shafts arranged through existing openings in the furnace wall and maintained in place from the outside of the furnace.

Each arc portion may further comprise a rigid reinforcement structure, the rigid reinforcement structure preferably extending between two end sections of the respective art section. The rigidity of the monorail is thereby further improved, reducing the instability of the monorail and improving its durability.

Another aspect of the disclosure relates to a method for mounting and/or dismantling staves on/from an inner wall of a shaft furnace, wherein the method comprises the steps of:

providing a device as described above, the device having a monorail being in its folded position;

introducing the monorail into the furnace through a maintenance opening;

bringing the monorail into its unfolded position within the furnace to form a circular monorail.

The step of introducing the device into the furnace comprises:

connecting the monorail to preferably two suspension cables previously introduced inside the furnace, and to preferably two other suspension cables outside of the furnace;

introducing the monorail through the maintenance opening together with the two other suspension cables.

The first two cables may be inserted inside the furnace through openings already existing for insertion of probes, like for example temperature or level probes. No modification of the furnace is required to introduce the suspension cables.

BRIEF DESCRIPTION OF THE DRAWINGS

Further details and advantages of the present disclosure will be apparent from the following detailed description of not limiting embodiments with reference to the attached drawing, wherein.

DETAILED DESCRIPTION

Figure 1:
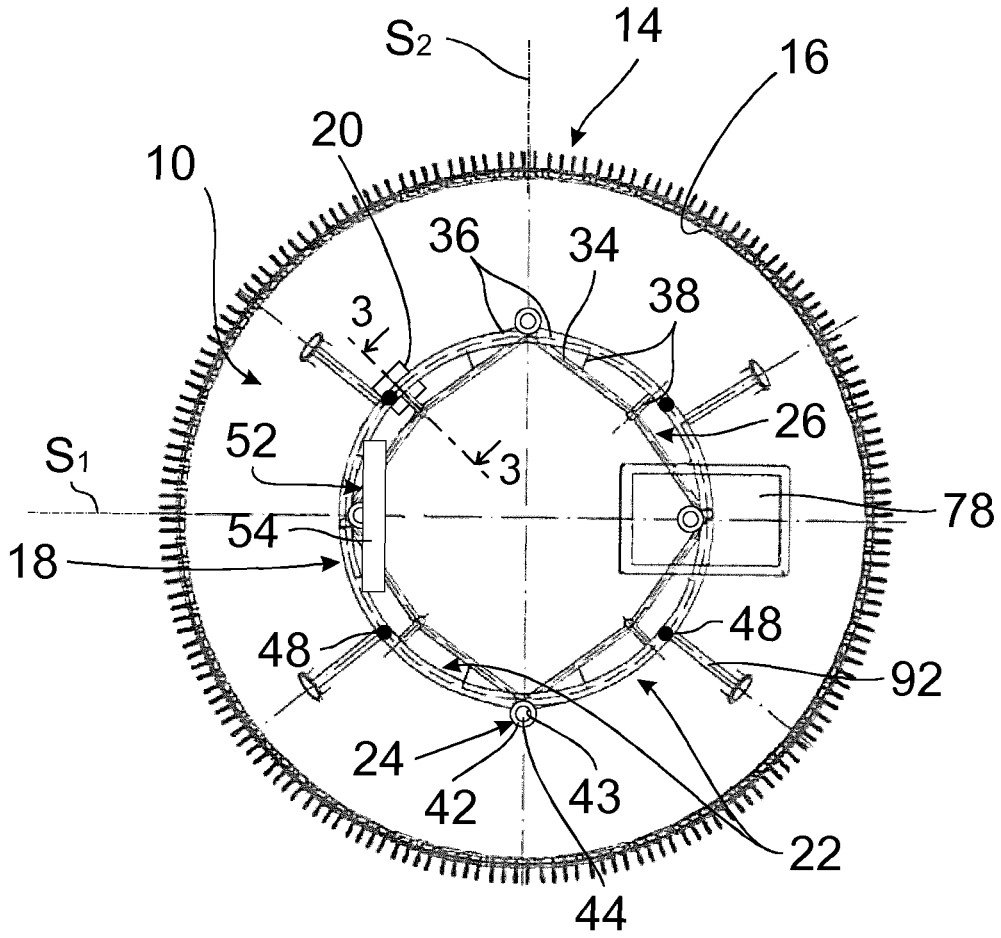
FIG. 1 is a schematic top view of an embodiment of the device according to the disclosure, wherein the monorail is in an unfolded position.
Figure 2:
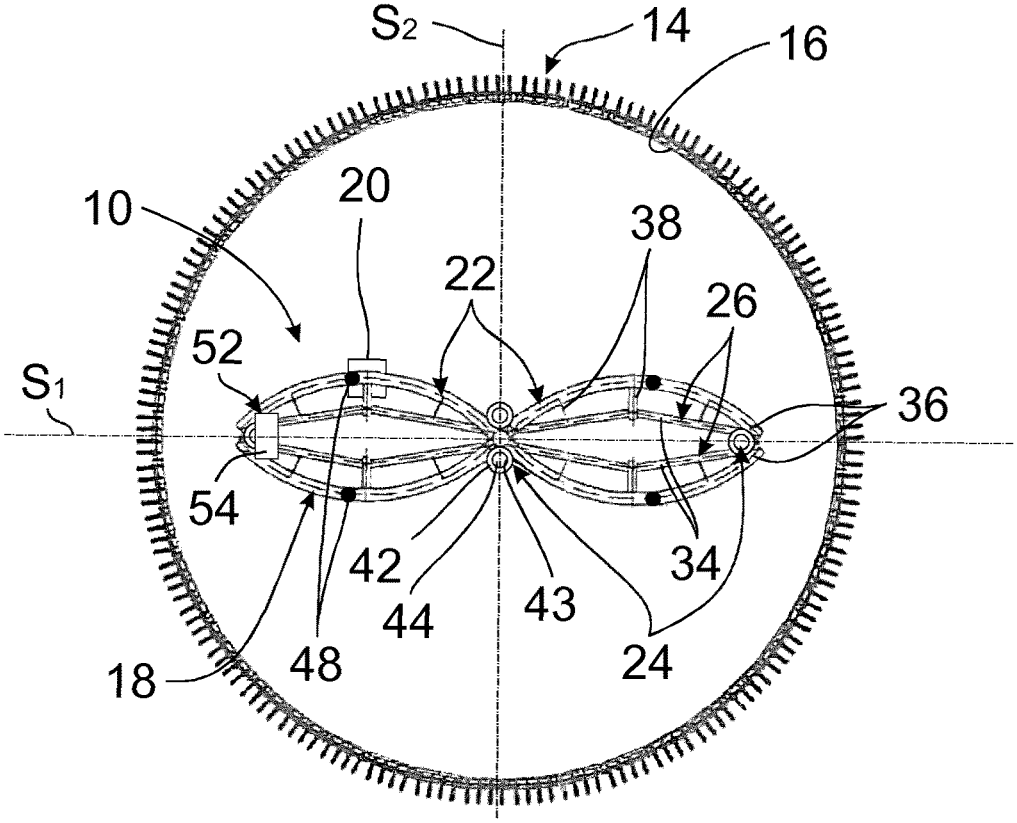
FIG. 2 is a schematic top view of the device of FIG. 1 wherein the monorail is in a folded position.

A device 10 according to a preferred embodiment of the disclosure is shown in FIGS. 1, and 2, inside a shaft furnace 12. The furnace comprises a shell 14 with an inner wall 16. The device 10 is configured for mounting and dismantling staves on/from the inner wall 16 of the shaft furnace 12.

The device 10 comprises a circular monorail 18 for supporting at least one stave positioning hoist 20. The monorail 18 is made of a rigid material, such as e.g. metal.

According to the disclosure, the monorail 18 is divided in four separate arc portions 22. Each arc portion 22 of the monorail 18 is connected to a neighboring one by a rotatable connection 24. The arc portions 22 are moveable between an unfolded position as shown in FIG. 1, in which the monorail 18 is circular, and a folded position as shown in FIG. 2, in which the overall size of the device 10 is, in one direction, reduced.

In the embodiment shown, each arc portion 22 has the same length and is bent in the shape of a quarter circle. The arc portion 22 further comprises a reinforcement structure 26 configured to strengthen the monorail 18, particularly when in the unfolded position. The reinforcement structure 26 may comprise two rigid beams 34 that are connected together and respectively connected to two ends 36 of the arc portion 22. The beams 34 may be connected together with a slight angle toward the arc portion 22. The beams 34 may further be fixed to the arc portion 22 through a plurality of spacers 38.

Figure 3:
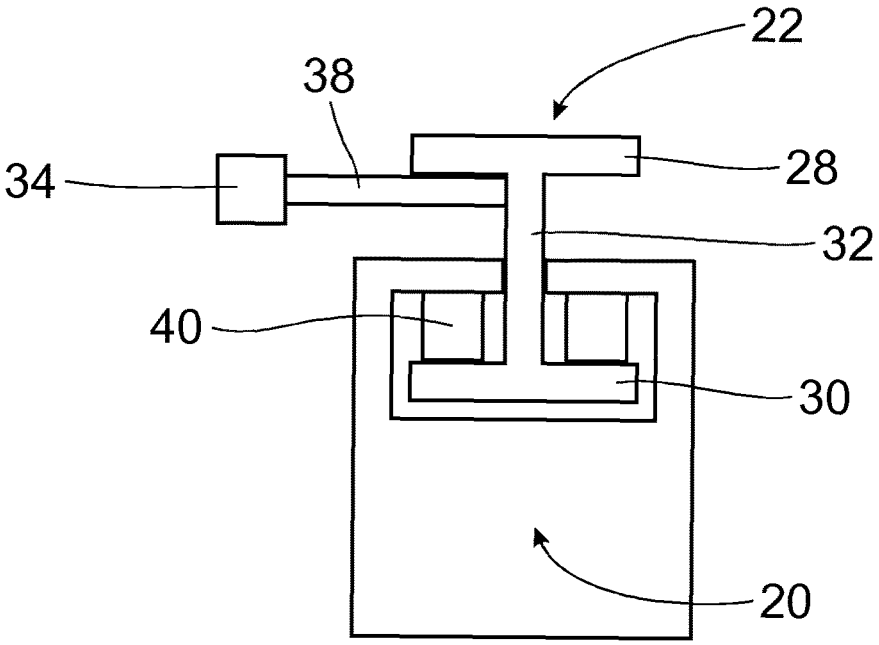
FIG. 3 is a schematic cross-section view through the plane 3-3 of FIG. 2.

FIG. 3 shows a cross-section of the monorail 18 in the plane 3-3 of FIG. 1. The arc portion 22 comprises an upper flange 28 and a lower flange 30 parallel to the upper flange 28. The upper and lower flanges 28, 30 are connected together by a web 32 so as to form a double T radial cross-section.

The spacers 38 may be fixed to the arc portion 22 and to the beam 34 by any suitable means, for example through welding. The spacers 38 are preferably fixed to the web 32 of the arc portion 22. In order to leave space for the stave positioning hoist 20, the spacers 38 are advantageously fixed to arc portion 22 as close as possible to the upper flange 28.

The stave positioning hoist 20 as shown in FIG. 3 is supported by the lower flange 30 of the arc portion 22. It comprises driving means 40 supported on top of the lower flange 30 of the monorail 18. The driving means 40 are configured to drive the stave positioning hoist 20 by rolling along the monorail 18. As can be seen in FIG. 3, the driving means 40 and the stave positioning hoist 20 are preferably configured to circulate below the beams 34.

The movement of the stave positioning hoist 20 is controlled remotely by a controller (not shown), which may communicate with the stave positioning hoist 20 wirelessly or via a connection cable or hose.

Each end 36 of the arc portion 22 comprises a rotatable connection 24. The rotatable connection 24 connects the end 36 of an arc portion 22 to the end 36 of a neighboring arc portion 22. The rotatable connection 24 as shown in FIGS. 1 and 2 is a pin construction. The pin construction is a common mechanical rotation link comprising two pierced parts 42 on top of one another. Each part 42 belongs to a respective neighboring arc portion 22. Each part 42 also comprises a through hole 43. The parts 42 are arranged with their respective through holes 43 concentric. A pin 44 is then inserted into the concentric through holes 43 and maintained by a locker (not shown).

As shown in FIGS. 1 and 2, the rotatable connections 24 are opposed two-by-two along two perpendicular diameters $S_1$, $S_2$, of the circle defined by the device in unfolded position. The two diameters further define two perpendicular axes of symmetry for the device 10.

When moving from the unfolded position to the folded position, the rotatable connections 24 in a first axis $S_1$ of symmetry move away from each other, while the rotatable connections 24 in a second axis $S_2$ of symmetry move closer toward each other. As a result, the monorail 18 is stretched along the first axis $S_1$, and shrunk along the second axis $S_2$. The overall size of the monorail is reduced in the direction of the second axis $S_2$. Advantageously, the device 10 is thus introduced inside the furnace 12 along the first axis $S_1$.

As described above, the monorail 18 is continuous when the device 10 is in unfolded position. It constitutes a circular rail that may be traveled by the stave positioning hoist 20 along the whole circumference of the rail.

In order to prevent discontinuity of the monorail 18, the rotatable connections 24 are not in line with an end 36 of the arc portions 22. The rotatable connections 24 are preferably located slightly away from a center of the cross-sections of the arc portions 22.

As shown in FIG. 1, the rotatable connections 24 along the first axis $S_1$ of symmetry are mounted on the inside of the circle defined by the monorail 18 in unfolded position. Indeed, these rotatable connections 24 are laterally arranged on the monorail 18 so as to face the center of the circle formed by the unfolded monorail 18. On the other hand, the rotatable connections 24 along the second axis $S_2$ of symmetry, are mounted outside of the circle defined by the monorail 18 in unfolded position. Indeed, these rotatable connections 24 are laterally arranged on the monorail 18 facing away from the center of the circle formed by the unfolded monorail 18.

The device 10 also comprises suspension means 46. The suspension means 46 are configured for suspending the monorail 18 inside the furnace 12 during a stave relining operation. The skilled person will understand that any suspension means may be used. Here, the suspension means 46 comprises four eyebolts 48 respectively provided on top of the upper flange 28 of each arc portion 22. The eyebolts 48 are schematically represented by dots in the figures.

The suspension means 46 further comprises four suspension cables 50. The suspension cables 50 are connected to the eyebolts 48 and to a secure fixing point arranged outside of the furnace.

The device 10 also comprises actuating means 52 arranged between two neighboring arc portions 22, the actuating system 52 being configured to fold and/or unfold the monorail 18. The actuating means 52 may e.g. comprise a hydraulic actuator 54 connected to a hydraulic pump (not shown) that is located outside of the furnace. When the hydraulic actuator 54 extends, it spreads the two neighboring arc portions 22 to which it is connected. This causes the two other arc portions 22 to spread equally in a symmetrical movement. The hydraulic actuator 54 is configured to extend until the monorail 18 reaches its circular unfolded position. The same reaction occurs when the hydraulic actuator shrinks pulling together the two neighboring arc portions 22 to which it is connected. The monorail 18 may comprise an abutment (not shown) that limits the extension of the hydraulic actuator to the unfolded position of the monorail.

It will be understood that instead of a hydraulic actuator, other actuators such as e.g. pneumatic or electric actuators may also be envisaged.

In the following description, we will describe the main elements of the shaft furnace 12 and the integration of the device 10 in the shaft furnace 12.

Figure 4:
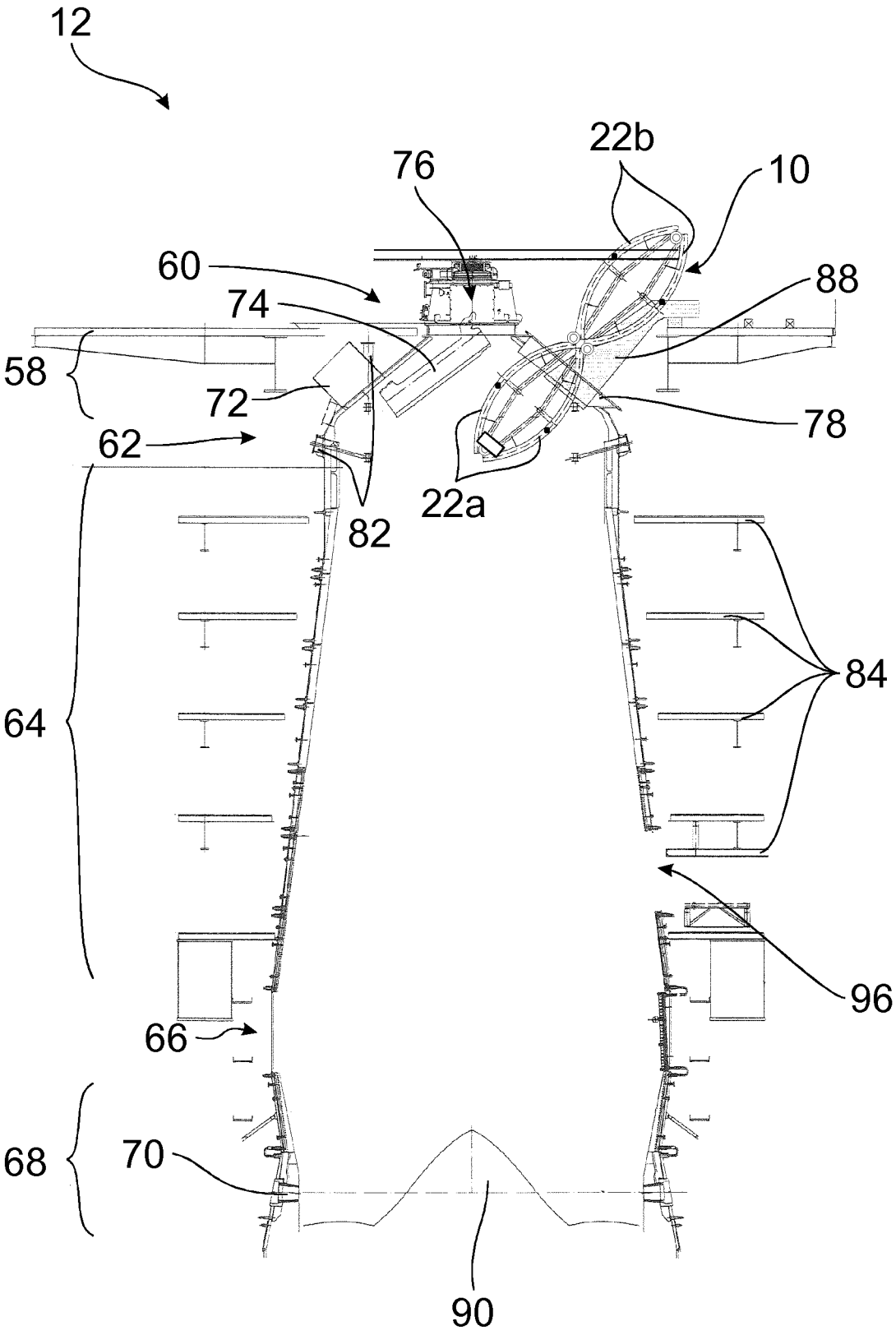
FIG. 4 is a schematic side view of a shaft furnace comprising a chute maintenance opening during a step of installation of the device of FIG. 1.

As shown in FIG. 4, the shaft furnace 12 comprises a top cone 58 area. The top cone 58 is topped by a chute assembly 60 and opens down to a throat 62 of the furnace 12. Below the throat 62, the furnace stretches over a part called the stack 64 area. The stack 64 area has a tapered shape growing wider from the throat 62 until the belly 66 area. The bottom of the furnace 12 comprises the hearth 68 located below a tuyere breast 70 from where hot gas is fed during metal fusion operations.

The top cone 58 comprises several large diameter offtakes 72 configured to evacuate the gas resulting from the fusion of the elements in the shaft furnace 12 and direct it into a recycling circuit, not shown.

The chute assembly 60 comprises a chute 74 configured to rotate inside the top cone 58. The chute 74 is controlled by a chute transmission gearbox 76. Above the chute transmission gearbox 76, the furnace 12 is further connected to one or more material hoppers controlled by a material gate (not shown).

In order to perform chute maintenance operations, the top cone 58 comprises a maintenance opening 78. The chute maintenance opening 78 is generally a rectangular opening located on the side of the top cone 58. The chute maintenance opening 78 comprises a removable cover plate (not shown) configured to seal the opening in a gastight connection.

The length of the maintenance opening 78 roughly covers the height of the top cone 58. The width of the maintenance opening 78 is commonly smaller than its length and adapted to leave access to the chute 74 to chute maintenance tools.

The top cone 58 further comprises several inlets 82 for probes used to measure the conditions inside the furnace 12 during operation. For example, the probes may measure the temperature or the level of the material inside the furnace.

Surrounding the furnace 12, there is a frame structure comprising various frame parts 84. The frame parts 84 constitute a support for the elements of the furnace 12 as well as a scaffold with a plurality of stories. The frame parts 84 allow the circulation of persons working on the furnace and the transportation of other elements such as replacement parts for furnace elements.

Figure 5:
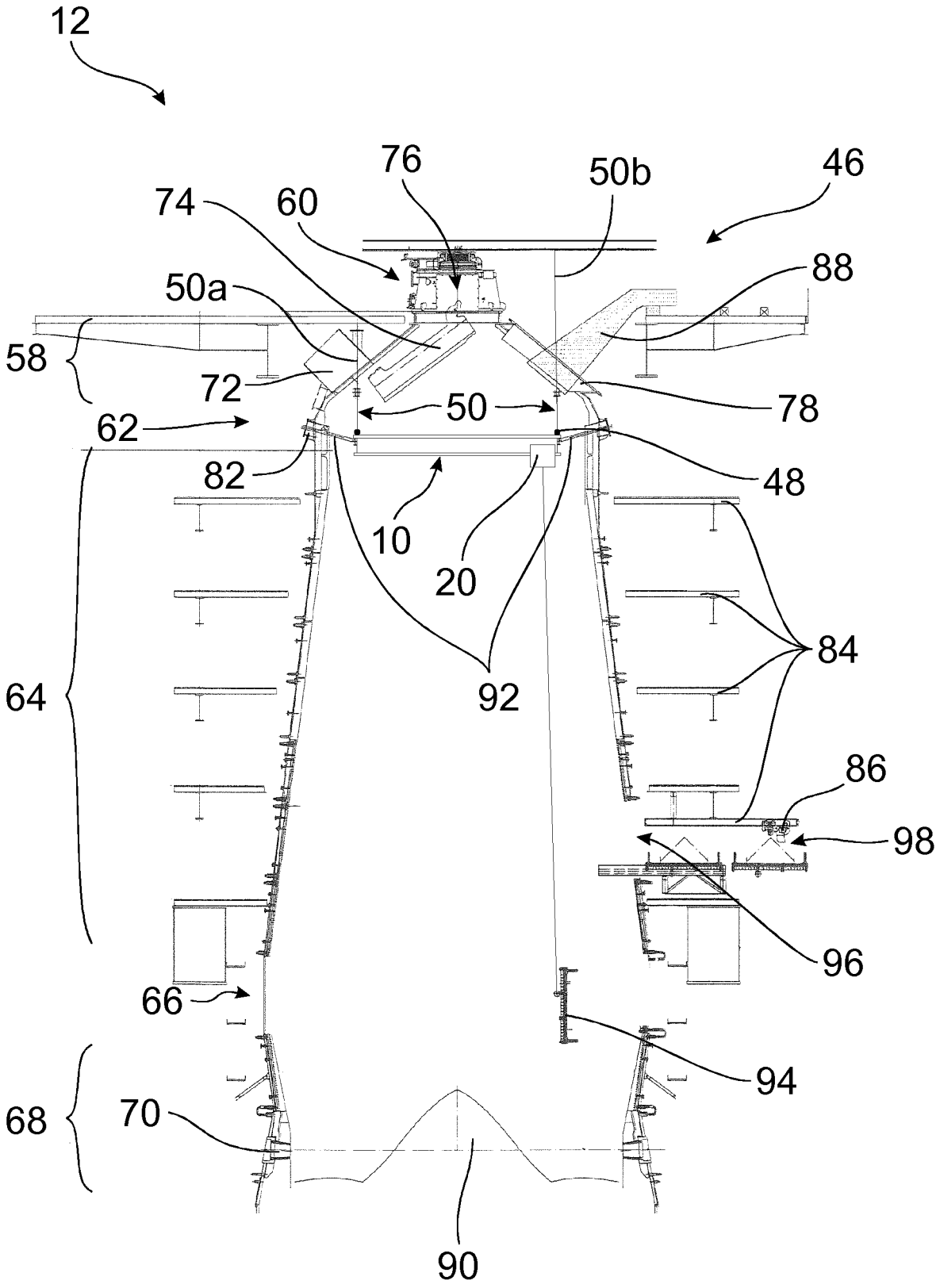
FIG. 5 is a schematic side view of a shaft furnace comprising the device of FIG. 1, during a step of a relining operation.

As shown in FIG. 5, the frame parts 84 may for example comprise a hoist 86 for carrying replacement staves in a lower level of the stack 64 area. In front of the chute maintenance opening 78, the frame parts 84 also comprise a ramp 88 for facilitating introduction of the monorail 18 into the furnace 12. The chute maintenance opening 78, with or without ramp 88, may also be used for conveying repair parts inside the furnace 12 through the maintenance opening 78.

A preferred embodiment of a method for installing the device 10 will now be described with reference to FIGS. 4 and 5.

Before installation, the furnace operation is reduced to its minimum without completely stopping it. The level of material inside the furnace is reduced to a lowest level, only keeping material in the hearth 68 area. The remaining material, or dead-man 90, corresponds to the material that is never extracted and remains in the bottom of the furnace during fusion operation. The presence of the dead-man 90 inside the furnace 12 implies that the conditions of temperature are still high in the bottom of the furnace but reasonably low in the higher parts of the furnace in order to allow the presence of a person.

For its installation inside the furnace 12, the device 10 is preferably in its folded position to be manipulated with ease. The device 10 is brought to the ramp 88 in front of the chute maintenance opening 78 and the opening cover plate is removed, allowing access to the inside of the furnace 12.

Insertion of the folded device 10 is performed in the direction of the first axis $S_1$ of symmetry. For a better understanding, the two first arc portions that will be first introduced into the furnace 12 will be called the front arc portions 22*a*. The two other arc portions will called back arc portions 22*b*.

Two front suspension cables 50*a* are attached at one end to a frame part 84 outside of the furnace 12 and at the other end to the eyebolts 48 of the two front arc portions 22*a* of the device 10. The front suspension cables 50*a* penetrate inside the furnace through existing probes inlet 82 after removal of the respective probes.

Preferably, the front suspension cables 50*a* are attached to the frame parts 84 and passed through the probe inlets 82. Then, the cables 50*a* are retrieved from inside the furnace 12 and pulled out through the maintenance opening 78. Finally, the front suspension cables 50*a* are attached to the front arc portions 22*a*.

Two back suspension cables 50*b* are attached to a frame part 84 of the furnace 12, and to the eyebolts 48 of the two back arc portions 22*b* of the device 10.

The monorail 18 is then lowered into the furnace while being guided by the ramp 88 until the back arc portions 22*b* are fully introduced inside the furnace 12. The back suspension cables 50*b* are fed into the furnace 12 together with the back arc portions 22*b*. The monorail 18 is hung by the front and the back suspension cables 50*a*, 50*b*.

After its introduction into the furnace 12, the monorail 18 is stabilized in a substantially horizontal position roughly in the throat 62 of the furnace 12 as shown in FIG. 5. It is to be noted that the dimensions of the monorail 18 are predetermined so that the diameter of the unfolded monorail 18 fits inside the throat 62 area of the furnace 12. Advantageously, the length along the first axis $S_1$ of the folded monorail is also smaller than the diameter of the throat 62.

The hydraulic actuator 54 of the actuating means 52 is then activated in order to unfold the monorail 18 into the unfolded position as explained above.

In order to prevent lateral movements of the monorail 18 the device 10 comprises four abutment members 92. The four abutment members 92 are introduced inside the furnace 12 through probe inlets 82 situated in the throat 62. The probe inlets used to introduce the abutment members 92 are different inlets as those used for the front suspension cables 50*a*. While it may be envisaged to connect the abutment members 92 to the monorail 18 by any suitable means (not shown), it is generally sufficient that the abutment members 92 are simply in contact with the monorail 18 to prevent lateral movement of the latter.

Figure 6:
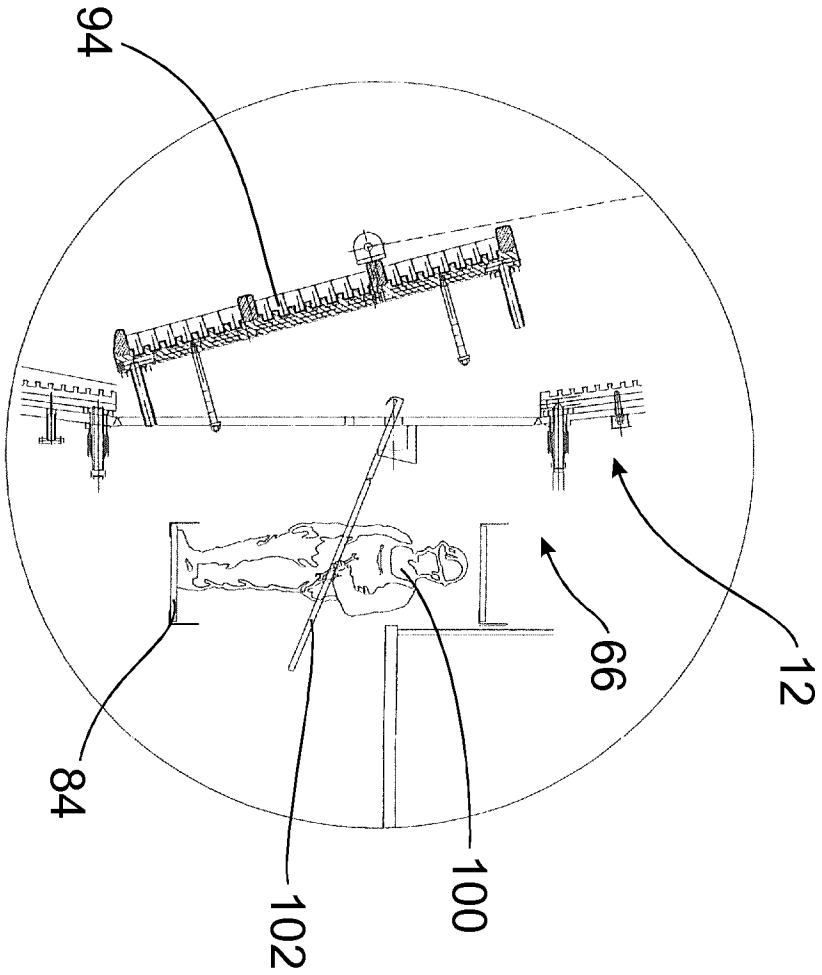
FIG. 6 is a schematic side view of a detail of a step of a relining operation.

We will now briefly explain the functioning of the device 10 for mounting a stave 94 on a wall of the furnace 12, with reference to FIGS. 5 and 6.

The stave 94 is first led to an insertion opening 96 of the furnace 12. The insertion opening 96 may be the same as the maintenance opening 78. Here, the insertion opening 96 is located in the stack 64 area of the furnace. A conveying system 98 brings the stave 94 to the insertion opening 96.

Then, the stave positioning hoist 20 of the device 10 is controlled in order to come to a radial and a height position, located in front of the insertion opening 96. A person manually attaches the stave 94 to the hoist 20 and the stave 94 is fed into the furnace 12 while suspended from the hoist 20. The hoist 20 moves to a radial and height position in front of the place where the stave 94 is to be installed. Here, the stave 94 is installed in the belly 66 area of the furnace 12.

As the stave positioning hoist 20 is configured to move along the entire circumference of the monorail 18, the stave 94 may be brought to any position inside the furnace 12.

As explained above, the stack 64 area that has a tapered shape growing from the top cone 58, and the diameter of the monorail 18 is adapted to be smaller than the diameter of the throat 62 area of the furnace 12. As shown in FIG. 5, when the stave 94 is lowered vertically by the stave positioning hoist 20 inside the stack 64 area, a space grows between the stave 94 and the wall of the furnace 12.

As shown in FIG. 6, a person 100 standing on a frame part 84 of the furnace may use a pole 102 in order to grab the stave 94 inside the furnace 12 and pull it against the wall of the belly 66 area. Afterward, the stave 94 is fixed using any suitable method.

The invention claimed is:

1. Device for mounting and/or dismantling staves on/from an inner wall of a shaft furnace, the device comprising a circular monorail for supporting at least one stave positioning hoist, wherein the monorail is divided into at least four separate arc portions, wherein each arc portion is connected to a neighboring arc portion by means of a rotatable connection;

wherein the arc portions are moveable between an unfolded position, in which the arc portions form a circular monorail, and a folded position, in which the overall size of the monorail is, in one direction, reduced, wherein at least one rotatable connection comprises actuating means arranged between neighboring arc portions, the actuating means being configured to move one arc portion relative to its neighboring arc portion.

2. Device according to claim 1, wherein the monorail comprises four arc portions of the same length.

3. Device according to claim 2, wherein, in the folded position, two opposite rotatable connections are arranged in proximity to one another, while the other two opposite rotatable connections are arranged far apart from one another.

4. Device according to claim 1, wherein the rotatable connections have their rotation axis parallel to each other.

5. Device according to claim 1, wherein the rotatable connections are formed by a pin construction.

6. Device according to claim 1, wherein the arc portions form a continuous circular monorail when the device is in its unfolded position.

7. Device according to claim 6, wherein two opposite rotatable connections are laterally arranged on the monorail so as to face the center of the circle formed by the unfolded device, while the other two opposite rotatable connections are laterally arranged on the monorail facing away from the center of the circle formed by the unfolded device.

8. Device according to claim 1, wherein the monorail is configured to support a plurality of stave positioning hoists.

9. Device according to claim 1, wherein the arc portions have a double T radial cross-section.

10. Device according to claim 1, wherein the monorail comprises a locking system configured to maintain the device in its unfolded position such that the arc portions form the circular monorail.

11. Device according to claim 10, wherein the locking system comprises at least one abutment between two neighboring arc portions.

12. Device according to claim 1, wherein the actuating means comprises a hydraulic, pneumatic or electric actuator.

13. Device according to claim 1, further comprising suspension means for mounting the monorail inside the shaft furnace, the suspension means comprising at least three suspension cables for suspending the monorail.

14. Device according to claim 13, wherein the suspension means comprises suspension cables passing through existing openings in the furnace and connected to a secure fixing point arranged outside of the furnace.

15. Device according to claim 1, further comprising a plurality of abutment members to prevent lateral movement of the unfolded monorail within the furnace.

16. Device according to claim 1, wherein each arc portion comprises a rigid reinforcement structure, the rigid reinforcement structure extending between two end sections of the respective arc portion.

17. Method for installing a device for mounting and/or dismantling staves on/from an inner wall of a shaft furnace, the method comprising the steps of:

providing a device according to claim 1, the device having a monorail being in its folded position;

introducing the monorail into the furnace through a maintenance opening;

bringing the monorail into its unfolded position within the furnace to form a circular monorail.

18. Method according to claim 17, wherein the device further comprises suspension cables for mounting the monorail inside the shaft furnace, the method further comprises the steps of:

feeding the suspension cables through existing openings in the furnace;

connecting the suspension cables to a secure fixing point arranged outside of the furnace.

* * * * *